US012305485B2

(12) United States Patent
Rutherford et al.

(10) Patent No.: US 12,305,485 B2
(45) Date of Patent: May 20, 2025

(54) WELL COLLAPSE RECONNECT METHOD

(71) Applicant: CONOCOPHILLIPS COMPANY, Houston, TX (US)

(72) Inventors: James S. Rutherford, Tananger (NO); Charles Colpitt, Tananger (NO); Andrew H. Whitfield, Tananger (NO)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 17/353,083

(22) Filed: Jun. 21, 2021

(65) Prior Publication Data

US 2022/0018202 A1 Jan. 20, 2022

Related U.S. Application Data

(60) Provisional application No. 63/052,277, filed on Jul. 15, 2020.

(51) Int. Cl.
*E21B 37/00* (2006.01)
*E21B 23/01* (2006.01)
(Continued)

(52) U.S. Cl.
CPC ..... *E21B 37/00* (2013.01); *E21B 23/01* (2013.01); *E21B 29/10* (2013.01); *E21B 33/124* (2013.01);
(Continued)

(58) Field of Classification Search
CPC ..... E21B 37/00; E21B 29/10; E21B 33/124; E21B 33/14; E21B 43/10; E21B 29/002; E21B 34/14
See application file for complete search history.

(56) References Cited

U.S. PATENT DOCUMENTS 3,052,298 A * 9/1962 Malott ..... E21B 33/14 166/290
5,318,122 A 6/1994 Murray et al.
(Continued)

FOREIGN PATENT DOCUMENTS

EA 201500410 A1 7/2017
EP 3255240 12/2017
(Continued)

OTHER PUBLICATIONS

Candice Ellison,et al (2018) Dielectric characterization of bentonite clay at various moisture contents and with mixtures of biomass in the microwave spectrum, Journal of Microwave Power and Electromagnetic Energy, 52:1, 3-15, DOI: 10.1080/08327823.2017.1421407 (Year: 2018).*
(Continued)

*Primary Examiner* — Theodore N Yao
(74) *Attorney, Agent, or Firm* — CONOCOPHILLIPS COMPANY

(57) ABSTRACT

Damaged casing or liner in a hydrocarbon well, e.g. caused by collapsed formation, is remediated using a unique straddle joint. Damaged liner is milled away and a straddle joint (20) located in the exposed ends of liner (8,9), bridging the gap between them and restoring most of the inner diameter. The straddle joint (20) includes cement ports (25) through which cement may be injected into any cavity (4) in the rock surrounding the straddle joint (20), thereby supporting the rock and helping to prevent further collapse.

6 Claims, 3 Drawing Sheets

(51) Int. Cl.

| | |
|---|---|
| ***E21B 29/00*** | (2006.01) |
| ***E21B 29/10*** | (2006.01) |
| ***E21B 33/124*** | (2006.01) |
| ***E21B 33/14*** | (2006.01) |
| ***E21B 43/10*** | (2006.01) |

(52) U.S. Cl.
CPC ..... *E21B 33/14* (2013.01); *E21B 43/10* (2013.01); *E21B 29/002* (2013.01)

(56) References Cited

U.S. PATENT DOCUMENTS

| | | | | |
|---|---|---|---|---|
| 2002/0023754 | A1 | 2/2002 | Buytaert | |
| 2005/0252662 | A1 | 11/2005 | Metcalfe et al. | |
| 2006/0016597 | A1* | 1/2006 | Emerson | E21B 43/103 166/207 |
| 2012/0305249 | A1* | 12/2012 | Connell | E21B 7/28 166/55.7 |
| 2015/0275605 | A1 | 10/2015 | Bennett et al. | |
| 2017/0226819 | A1 | 8/2017 | Carragher | |
| 2018/0187492 | A1* | 7/2018 | Amri | E21B 21/003 |
| 2020/0088002 | A1* | 3/2020 | AlShuraim | E21B 33/138 |

FOREIGN PATENT DOCUMENTS

| | | | |
|---|---|---|---|
| RU | 2386779 | C1 * | 4/2010 |
| RU | 2515739 | C1 | 5/2014 |

OTHER PUBLICATIONS

International Search Report for PCT/US2021/38253 mailed Sep. 23, 2021; 3 pgs.

Innes, Gareth, et al—"The Use of Expandable Tubular Technology to Enhance Reservoir Management and Maintain Integrity", 2003, OTC 15148, Offshore Technology Conference Houston, TX May 5-8, 2003, pp. 1-6; 6 pgs.

* cited by examiner

WELL COLLAPSE RECONNECT METHOD

CROSS-REFERENCE TO RELATED APPLICATIONS

This application is a non-provisional application which claims benefit under 35 USC § 119(e) to U.S. Provisional Application Ser. No. 63/052,277 filed Jul. 15, 2020 entitled "WELL COLLAPSE RECONNECT SYSTEM," which is incorporated herein in its entirety.

STATEMENT REGARDING FEDERALLY SPONSORED RESEARCH

None.

FIELD OF THE INVENTION

This invention relates to remediation of collapsed, deformed or buckled well casing.

BACKGROUND OF THE INVENTION

Oil and gas wells may suffer from collapsed or buckled pipe, such as steel casing. This can occur both in oil bearing rock (the reservoir) and the rock above (overburden).

Causes can be attributed to high shear/strain regimes in overburden to voids created by stimulation practices in past. Buckling/collapse can cause restrictions in liners or casing, limiting access to liner or casing below and ultimately limiting intervention operations and production. The effective inner diameter of the casing or liner is reduced which limits the tooling which can be passed down the well, or can prevent any tooling being passed down.

It would be desirable to be able to re-establish the casing or liner with full or nearly full inner diameter over all its length, so that tools may be passed down, e.g. for completion/stimulation operations.

EP3255240A1 (Welltech) describes a straddle assembly for use in an open hole, isolating a zone which is damaged or is producing too much water.

EA201500410A1 describes remediating damaged casing by filling with cement and then milling out a bore of approximately the same inner diameter as the casing.

BRIEF SUMMARY OF THE DISCLOSURE

The invention more particularly includes a process for remediating a well having a restriction caused by inward deformation of a well casing or liner, the process comprising: a) passing down the well a milling tool and milling away casing or liner in the region of the restriction such that rock surrounding the casing or liner is exposed and such that the casing or liner is divided into an upper and a lower portion each having an open end; b) passing down the well a straddle joint tool; and c) locating the straddle joint tool in the upper and lower portions of casing or liner. In this way the gap between the upper and lower portions of casing or liner is bridged. The casing or liner becomes, in effect, a continuous length of tubing again, without a restriction, although the internal diameter of the straddle joint will inevitably be somewhat less that the internal diameter of the original casing or liner.

Between steps (a) and (b), an under-reaming operation may be performed to ream away rock and/or cement in a region between the upper and lower portions of liner or casing. A wash operation may then be performed to remove loose rock, cement and/or metal swarf. The wash and milling and under-reaming operations may be performed in one run using a tool string with appropriate milling, under-reaming and washing tools.

A seal may be made between the straddle joint and the upper and lower casing portions, e.g. using a packer. This may prevent leakage of fluid between the interior of the casing or liner and the formation, and/or may allow the interior of the liner or casing to be maintained at a different pressure to its surroundings.

In some embodiments, the straddle joint may grip the interior surface of the upper and lower portions of casing or liner (for example using slips) and the straddle joint may be placed in axial compression. This may be done to help support the formation, which may have collapsed in the region of the deformed casing or liner, which may have been the reason for the casing or liner becoming damaged.

After placement of the straddle joint, cement or other settable medium may be injected outwardly through a port, or normally several ports, in the straddle joint. If the surrounding rock has collapsed, this may help support the rock and reduce the chance of further collapse. This is especially the case if there is a void in the rock adjacent the straddle joint (formerly adjacent the restriction in the casing or liner).

It is thought that voids and/or regions of collapsed rock may form in a reservoir (as opposed to the overburden), for example, due to past stimulation operations. Such stimulation operations may involve the injection of acid into the rock to open up fissures in the rock to allow hydrocarbons to flow more readily; however, the acid may dissolve away large portions of rock and create voids and/or instability.

It may be desirable to circulate wash fluid again through a port or ports in the straddle joint. The port or ports may be the same as those from which cement is to be delivered, or may be separate ports. Wash fluid is circulated, for example, in order to clear out any remaining swarf from the milling operation or loose rock debris or other loose material around the exterior of the straddle joint.

The port or ports may be closed after the wash and cement operation is finished. Normally, the straddle joint may be delivered downhole on a running tool which may be designed in a well-known manner to guide wash fluid and cement through the ports and actuate any seals or slips before being withdrawn from the well. As the running tool is withdrawn, it may move a closing sleeve or other closure over the port(s).

According to one embodiment, a straddle joint comprises: (a) a generally tubular body; (b) upper and lower seals, such as packers, axially spaced along the body; (c) a cement port or ports in the body, located between the seals.

The cement port or ports may be closable. A closure member, such as an axially slidable sleeve, may be provided. This member may be moved to a closed position by withdrawal of a running tool on which the straddle joint has been delivered.

The straddle joint may have upper and lower gripping means, such as slips, axially spaced along the body, for gripping an interior surface of liner or casing. Slips may secure the straddle joint in the upper and lower portions of casing or liner with sufficient strength to allow the straddle joint to be installed under compressive load. As previously stated, this may help support the rock.

Examples and various features and advantageous details thereof are explained more fully with reference to the exemplary, and therefore non-limiting, examples illustrated in the accompanying drawings and detailed in the following description. Descriptions of known starting materials and processes can be omitted so as not to unnecessarily obscure the disclosure in detail. It should be understood, however, that the detailed description and the specific examples, while indicating the preferred examples, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, product, article, or apparatus that comprises a list of elements is not necessarily limited only those elements but can include other elements not expressly listed or inherent to such process, process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The term substantially, as used herein, is defined to be essentially conforming to the particular dimension, shape or other word that substantially modifies, such that the component need not be exact. For example, substantially cylindrical means that the object resembles a cylinder, but can have one or more deviations from a true cylinder.

Additionally, any examples or illustrations given herein are not to be regarded in any way as restrictions on, limits to, or express definitions of, any term or terms with which they are utilized. Instead these examples or illustrations are to be regarded as being described with respect to one particular example and as illustrative only. Those of ordinary skill in the art will appreciate that any term or terms with which these examples or illustrations are utilized encompass other examples as well as implementations and adaptations thereof which can or cannot be given therewith or elsewhere in the specification and all such examples are intended to be included within the scope of that term or terms. Language designating such non-limiting examples and illustrations includes, but is not limited to: "for example," "for instance," "e.g.," "In some examples," and the like.

Although the terms first, second, etc. can be used herein to describe various elements, components, regions, layers and/or sections, these elements, components, regions, layers and/or sections should not be limited by these terms. These terms are only used to distinguish one element, component, region, layer or section from another. Thus, a first element, component, region, layer or section discussed below could be termed a second element, component, region, layer or section without departing from the teachings of the present inventive concept.

While preferred examples of the present inventive concept have been shown and described herein, it will be obvious to those skilled in the art that such examples are provided by way of example only. Numerous variations, changes, and substitutions will now occur to those skilled in the art without departing from the disclosure. It should be understood that various alternatives to the examples of the disclosure described herein can be employed in practicing the disclosure. It is intended that the following claims define the scope of the disclosure and that methods and structures within the scope of these claims and their equivalents be covered thereby.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
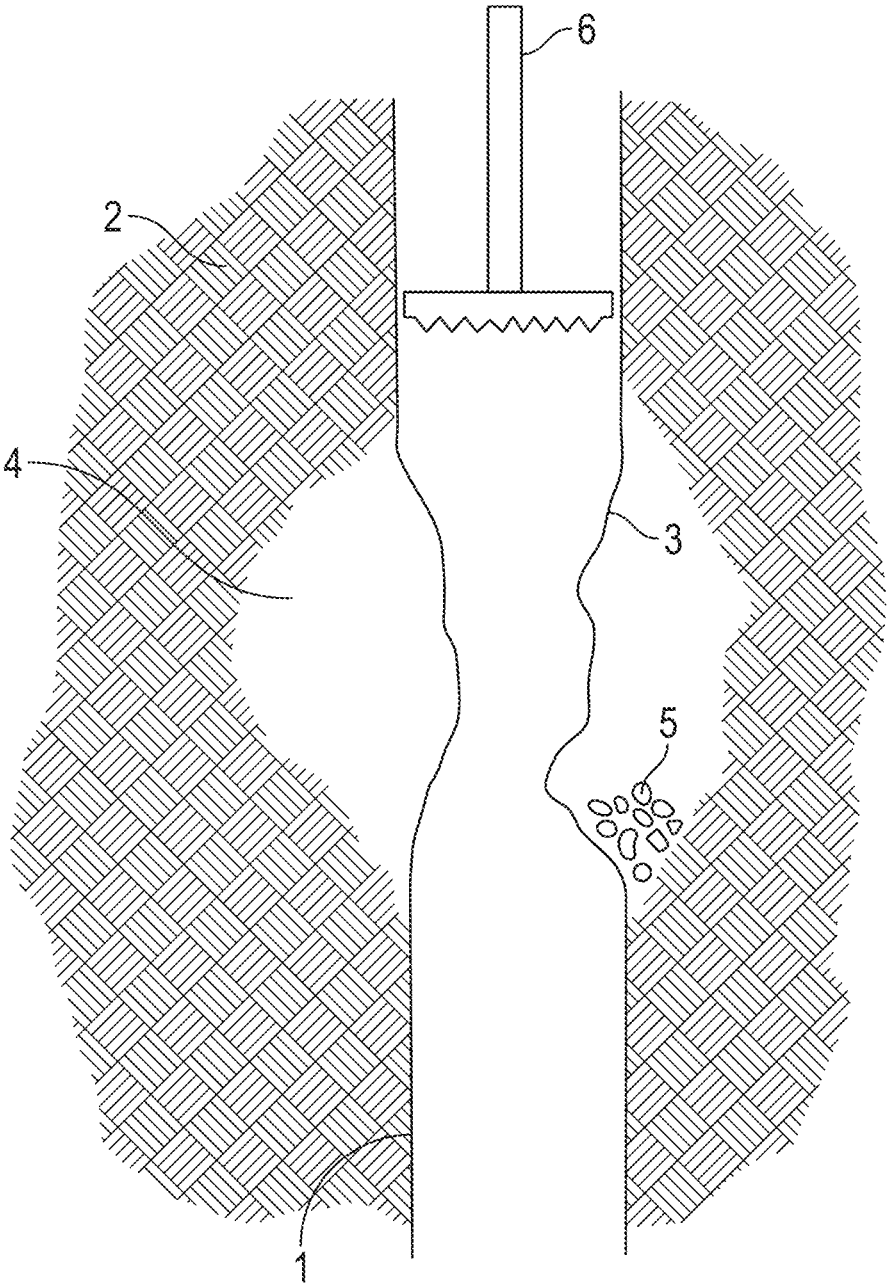
FIG. 1 is a schematic cross section though a liner in a reservoir rock formation, showing a collapsed section of the formation and buckled portion of liner.

Referring firstly to FIG. 1, a liner 1 passing through a reservoir formation 2 has a buckled region 3 where the internal diameter of the liner is severely restricted. The formation 2 has partially collapsed, leading to a void 4 in the region of the buckled casing. The void 4 is partially filled with broken rock or rubble 5.

When formation collapses, a void is not necessarily formed and the exact state of the formation in the region of the buckled liner may not be known and could be solid, cracked or broken rock, void spaces or a mixture of any of these.

The collapse need not necessarily be in the reservoir but could be in the overburden, in which case the situation is the same as that described above and shown in FIG. 1, except that reference numeral 1 would in that event refer to casing rather than liner. However, the inventors believe that formation collapse is more prevalent in reservoir rock where draining of hydrocarbons and stimulation, e.g. with acid, may affect the formation pressure, the strength of the formation and/or create cracks or voids in the rock.

The region of FIG. 1 described as formation, may in some cases include cement, for example if the liner or casing was cemented in place when the well was first established.

Deformation of casing or liner can severely limit the downhole procedures which may be performed on the well. The size of tool which it is possible to pass down the casing or liner may be restricted, thereby restricting the types of procedure to those which may be carried out using downhole tools with a relatively small outer diameter.

In some cases the deformation may be so severe that it is not possible to get any tool past the restriction, in which case procedures are limited to bullheading fluids into the casing or liner beyond the restriction (i.e. simply passing fluids down the well under pressure).

The inventors have conceived a way of addressing this problem. They have devised a reconnect system and method which includes milling out the liner/casing and then reconnecting the milled ends with modified a straddle packer assembly. To the inventors' knowledge a straddle assembly has never been run in this way to connect two liner/casing stumps with open hole between the two liner/casing stumps.

FIG. 1 shows a milling tool 6 (e.g. a bullnose mill) being run down the liner 1 on drillpipe 7. The milling tool 6 is of a well-known type, capable of milling out a bore with substantially the inner diameter of the liner.

Figure 2:
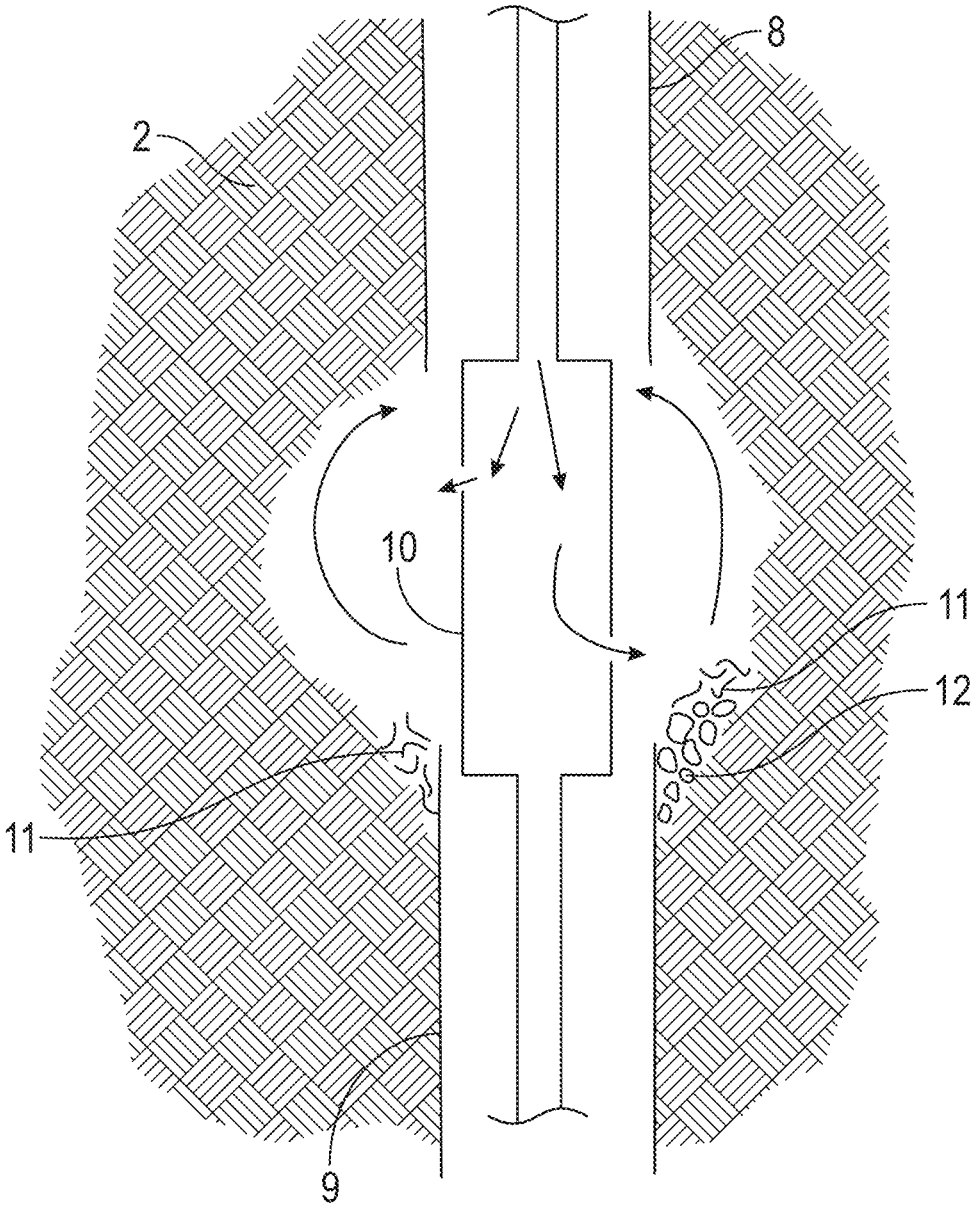
FIG. 2 is a view similar to FIG. 1, showing a wash tool cleaning out a rock cavity.

FIG. 2 shows the liner after the milling operation; the buckled part of the liner has been milled away, leaving an upper liner portion 8 and a lower liner portion 9, and the milling tool (not shown in FIG. 2) has advanced beyond the milled section. The interior of the liner is now exposed to the rock formation 2.

If there had been no void 4 in the rock and instead the rock had come right up to the exterior of the deformed region 3 of liner, then the milling tool 6 would have milled away rock as well as steel. In any event, there will normally be metal swarf 11 in the milled away region as well as rock debris 12 either due to formation collapse, milling or both. It may be desirable, e.g. if there is rock adjacent the milled away section, to under-ream, that is to say to use an under-reaming milling tool which is capable of milling away rock and/or cement to a larger internal diameter than the liner. The underreamer tool is not shown, but its design and operation will be familiar to those skilled in this field. If an under-reaming step is performed, this will obviously also create rock and/or cement debris 12.

On the same drill string assembly as the milling tool 6 (and underreamer if present) is a wash tool 10 which, in FIG. 2, has been advanced into position adjacent the milled section. Wash fluid (e.g. drilling mud) is circulated through the wash tool as shown by the arrows in FIG. 2, in a conventional manner. The wash tool 10 would normally be moved axially within the liner to wash fully the milled area and the exposed ends of liner and clear away far as possible all metal, rock and cement debris.

Figure 3:
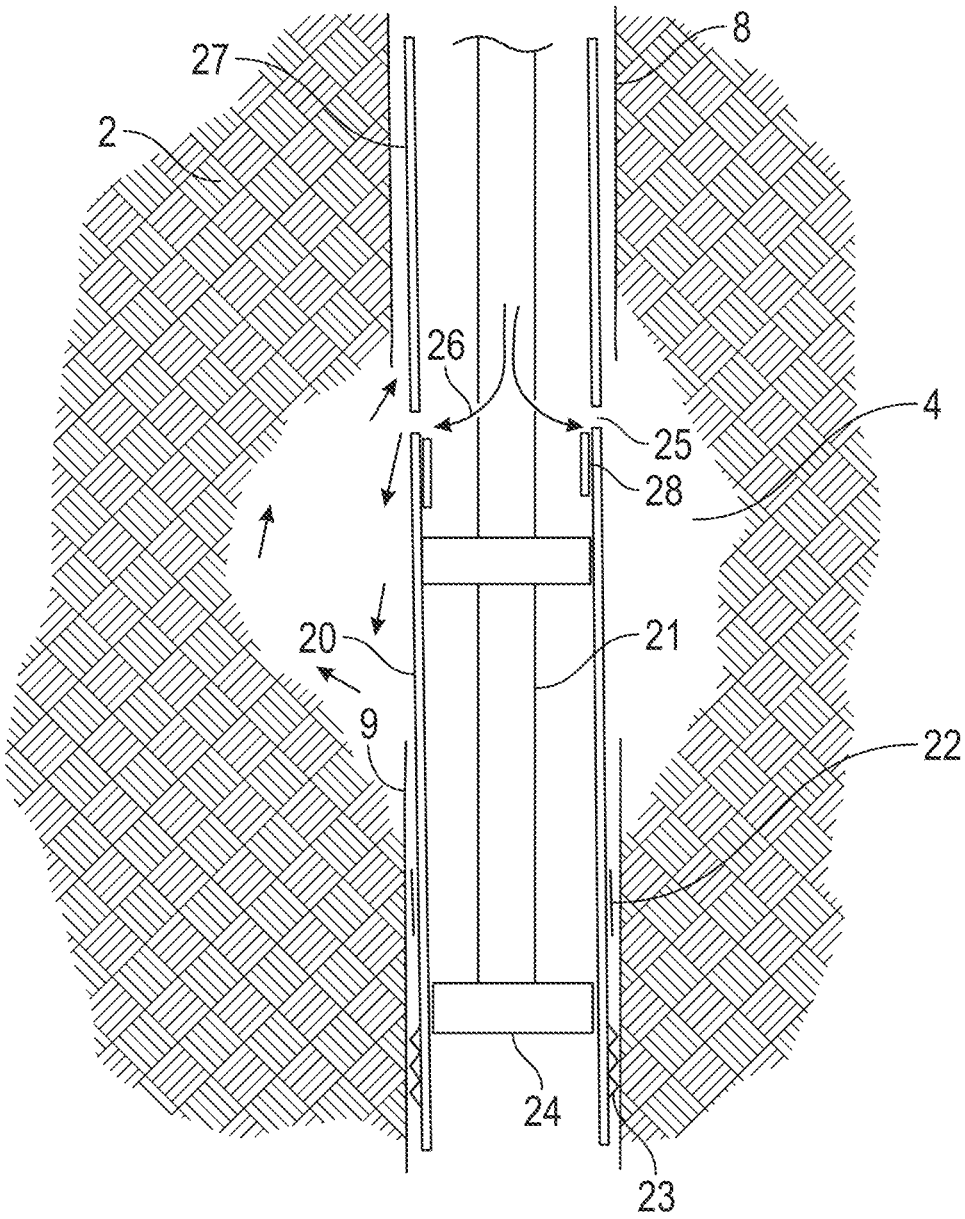
FIG. 3 is a view similar to FIGS. 1 and 2, showing a straddle joint according to the invention in the process of being delivered by a running tool.

Once the washing operation is complete, the milling and washing assembly is withdrawn and then a straddle joint run into the well on a running tool. FIG. 3 shows, in highly schematic form, a straddle joint 20 and associated running tool 21. The straddle joint 20 can be seen to have entered the lower portion 9 of liner and be bridging the gap between the lower portion 9 and upper portion 8 of the liner.

At the lower end of the straddle joint 20 is a packer 22 and slips 23, both of which have been set by means of an actuating mechanism 24 of the running tool. The details of such mechanisms would be well known to those with knowledge of this field. As an alternative, a hydraulic system could be used to set the packer seal and slips. The function of the packer 22 is, when set, to seal against the interior of the liner, while the function of the slips 23 is, when set, to grip the interior of the liner so that the straddle may withstand downward axial loading and not move with respect to the liner.

Towards the upper end of the straddle joint 20, but not in the part of the straddle joint which is received in the upper portion 8 of the liner, are a number of wash/cement ports 25. The running tool also includes ports 26 for delivering wash fluid or cement.

Wash fluid (drilling mud) is again circulated though the ports 25, 26 and up through the annulus 27 between the straddle joint and liner (see arrows in FIG. 3 indicating flow). Cement is then delivered through the same ports into the annulus or void 4 surrounding the straddle joint 20, displacing the wash fluid and filling the annulus or void 4.

An upper packer and slips (not shown) may be set by an upper actuating mechanism (not shown) and engaged with the interior of the upper portion 8 of liner in exactly the same way as described for the lower packer and slips 22, 23. Prior to setting the upper slips, the straddle joint may be placed in compression, e.g. by setting string weight down while applying pressure. Alternatively, this could be accomplished in a secondary run or mechanically actuated through rotation while setting string weight down on top of straddle assembly.

The running tool is then released from the straddle joint by means which would be well known to those knowledgeable in this field and pulled out of the well. The action of pulling the running tool moves a closure sleeve 28 across the cement ports 25 of the straddle joint 20.

As the running tool is pulled out of the well, there may be further circulation of wash fluid to clean away any residual cement on the interior of the straddle joint and upper liner portion 8. After full withdrawal of the running tool, a clean out string (well-known to those knowledgeable in this field) may be run the full length of the well. Pressure tests may be performed to test the packer seals.

With access through the full wellbore restored, standard downhole operations, e.g. stimulation, may be performed. In one example, a 127 mm (5.0") casing or liner with a nominal inner diameter of 102.7 mm (4.044") could be restored to a 70 mm (2.75") nominal ID using a 89 mm (3.5") straddle. in another example, a 273 mm (10.75") casing or liner with a nominal ID of 243 mm (9.56") could be restored to 141 mm (6.56") nominal ID using a 197 mm (7¾") straddle.

Increase in production and access to lower reservoir sections would vary by well, but for example wells with uplift values of 80 $m^3$ per day or more (500 barrels per day) would likely be identified as candidates. The ability to re-access lower reservoir sections and re-stimulate, descale, and allow production are all benefits.

It is envisaged that long sections of damaged liner or casing may be remediated using this method and tooling. For example a length of anything from 0.3 to 152 metres (1 to 500 feet), 3 to 91 metres (10 to 300 feet), or 6 to 61 metres (20 to 200 feet) may be milled away and replaced. The straddle tool may be modular and may be assembled to fit the job. The diameter of the straddle joint will of course be selected according to the diameter of casing or liner which is damaged. Upper and lower parts of the straddle, which have the packers and slips and (normally in the case of the upper part) the cement ports, are assembled with an appropriate length of steel tubing (e.g. washpipe) between them.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication data after the priority date of this application. Incorporated references are listed again here for convenience:

1. EP3255240A1 (Welltech) Downhole Straddle System (2017).
2. EA201500410A1, Method of Repair in a Well with a Defective Section and Internal Restriction of a Casing String, and Device for Its Implementation (2016).

The invention claimed is:

1. A process for remediating a well having a restriction caused by inward deformation of a well casing or liner, the process comprising:

a) passing down the well a milling tool and milling away casing or liner in a region of the restriction such that rock surrounding the casing or liner is exposed and such that the casing or liner is divided into an upper and a lower portion each having an open end;

b) performing an under-reaming operation to ream away rock and/or cement in a region between the upper and lower portions of liner or casing;

c) performing a wash operation to remove loose rock, cement and/or metal swarf from a pre-existing void in the rock surrounding the casing or liner;

d) passing down the well a straddle joint;

e) locating upper and lower ends of the straddle joint in the upper and lower portions of casing or liner;

f) after placement of the straddle joint, injecting cement or other settable medium outwardly through a port in the straddle joint into the pre-existing void in the rock surrounding the casing or liner;

wherein said inward deformation creates a pre-existing void in the rock adjacent the restriction in the casing or liner, wherein the cement or other settable medium enters and substantially fills the pre-existing void adjacent the exterior of the straddle joint, thereby supporting against collapse of the rock.

2. The process according to claim 1, including forming a seal between the straddle joint and the upper and lower casing portions.

3. The process according to claim 1, wherein the straddle joint grips the interior surface of the upper and lower portions of casing or liner.

4. The process according to claim 3, wherein the straddle joint is placed in axial compression.

5. The process according to claim 1, wherein, prior to injection of cement or other settable medium, wash fluid is circulated through the port in the straddle joint.

6. The process according to claim 1, wherein, following injection of cement, the port is closed.

* * * * *